United States Patent [19]

Walter

[11] 4,247,011

[45] Jan. 27, 1981

[54] MODULAR SHELVING

[76] Inventor: Philip J. Walter, 4109 Victoria St., Minnetonka, Minn. 55343

[21] Appl. No.: 38,921

[22] Filed: May 14, 1979

[51] Int. Cl.[3] ..... A47B 53/00

[52] U.S. Cl. ..... 211/194; 312/111; 312/198

[58] Field of Search ..... 312/108, 111, 198–201; 211/153, 188, 184, 194; 108/11, 12, 91, 110

[56] References Cited

U.S. PATENT DOCUMENTS

| | | | |
|---|---|---|---|
| 1,648,277 | 11/1927 | Korb | 312/108 |
| 2,506,844 | 5/1950 | Smith | 312/107 |
| 3,257,154 | 6/1966 | Lewis | 312/198 |
| 3,490,598 | 1/1970 | Federman | 211/153 |
| 3,549,020 | 12/1970 | Von Bohr | 108/91 |
| 3,567,302 | 3/1971 | Carlson | 312/199 |
| 3,613,604 | 10/1971 | Butler | 211/153 |
| 3,722,704 | 3/1973 | Piretti | 312/108 |
| 4,008,932 | 2/1977 | Wildschut | 312/108 |
| 4,095,858 | 6/1978 | Hopf | 312/198 |

*Primary Examiner*—Casmir A. Nunberg

*Attorney, Agent, or Firm*—Kinney, Lange, Braddock, Westman and Fairbairn

[57] ABSTRACT

A modular shelving assembly includes a plurality of identical quadrilateral modules which may be stacked and arranged to form shelving assemblies. Each module has a first base and a second base and first and second side walls which define an open front of trapezoidal shape. The first and second bases are parallel to one another, with the first base being wider than the second base. The shelving assembly also may include trapezoidal shaped shelves which are inserted into the module and slope downward from the back edge to the front edge. Triangular honeycomb inserts may also be inserted into the modules to divide a particular module into a plurality of sections.

21 Claims, 12 Drawing Figures

MODULAR SHELVING

BACKGROUND OF THE INVENTION

1. Field of the Invention

The present invention relates to structural assemblies. In particular, the present invention relates to modular assemblies in which a structure such as display shelving is formed by a plurality of essentially identical modules.

2. Description of the Prior Art

In the prior art, modular units have been developed for shelving, bookcases, cabinetry, tables, and the like. Use of modular units permits flexibility in the overall size of the assembly being formed, and permits the same basic building block to be used for a variety of different structures. Examples of modular assemblies are shown in the following patents:

Korb: U.S. Pat. No. 1,648,277
Smith: U.S. Pat. No. 2,506,844
Lewis: U.S. Pat. No. 3,257,154
Von Bohr: 3,549,020
Carlson: U.S. Pat. No. 3,567,302
Piretti: U.S. Pat. No. 3,722,704
Wildschut: U.S. Pat. No. 4,008,932
Hopf: U.S. Pat. No. 4,095,858

In general, most of the modular assemblies have been rectangular in shape, or have produced a rectangular shaped structure. Examples of this kind of assembly include the Korb, Von Bohr, Smith, and Piretti patents listed above.

Another shape of module which has been used in the past is shown in the Carlson U.S. Pat. No. 3,564,302 and the Hopf U.S. Pat. No. 4,095,858. In these patents, P-shaped modules are used.

The Lewis U.S. Pat. No. 3,257,154 shows another modular element which has a rectangular front, a smaller rectangular back, and rectangular sides. The top and bottom of the container are both trapezoidal in shape. When the modules are arranged side-by-side, the open walls of the modules do not all face in the same direction. This significantly limits the uses of the modules.

The structural elements shown in the Wildschut U.S. Pat. No. 4,008,932 utilize hexagonal shaped modules. Both shelving units and other types of furniture are shown utilizing this basic hexagonal element.

One advantage of modular structures is that the individual module may be much smaller and easier to transport than the entire assembled structure. There is a continuing need, however, for modular structures which break down into very small, compact, and easy-to-ship modules and components. Another continuing need is for structures which are easily assembled, and which do not require an excessive number of fasteners and connectors.

SUMMARY OF THE INVENTION

The present invention is a structure which includes a plurality of identical quadrilateral modules. Each module has a first base and a second base, and first and second side walls which define an open front of trapezoidal shape. The first and second bases are parallel to one another, with the first base being wider than the second base.

In the preferred embodiments of the present invention, the modules are arranged in stacked, inverted relationship so that bases of essentially equal width of an upper and lower module are positioned proximate one another. The modules may also be arranged in side-by-side as well as in stacked relationship so as to provide a wide variety of attractive structures for shelving, product displays, bookcases, cabinets, and the like.

The structure of the present invention preferably also includes trapezoidal shaped shelves which may be inserted in those modules having the wider first base at the top. The shelves require no fasteners and may be easily and rapidly inserted and removed. The trapezoidal shaped shelves have a front edge, a back edge, and first and second side edges. The front and back edges of the shelf are essentially parallel to one another, and the back edge has a width which is less than or equal to the width of the first base. The front edge of the trapezoidal shaped shelf has a width which is less than the width of the back edge of the shelf and is greater than or equal to the width of the second base. When the trapezoidal shaped shelf is inserted into the module, it slopes downward from the back edge to the front edge. The amount of the incline or slope depends upon the size of the trapezoidal shaped shelf and the size of the module.

BRIEF DESCRIPITON OF THE DRAWINGS

DETAILED DESCRIPTION OF THE PREFERRED EMBODIMENTS

Figure 1:
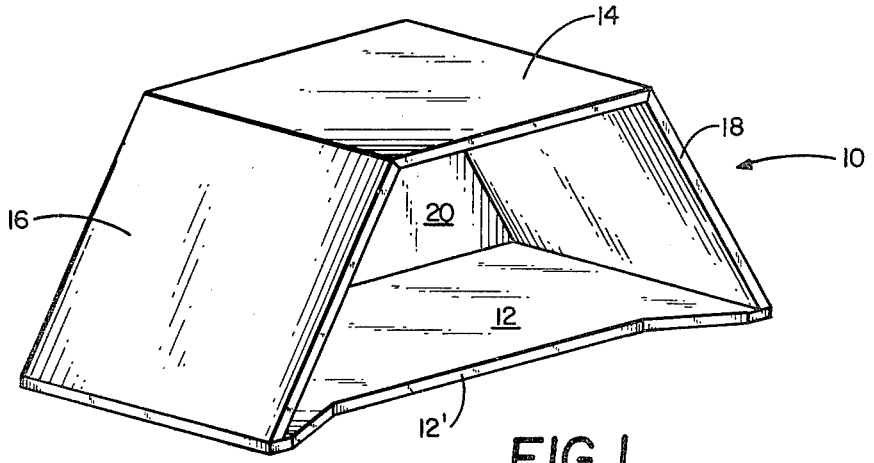
FIG. 1 shows a perspective view of a module of the present invention.

FIG. 1 shows a preferred embodiment of the basic structural module of the present invention. As shown in FIG. 1, module 10 includes first base 12, second base 14, first and second sides 16 and 18, and back 20. First and second bases 12 and 14 are parallel to one another and generally horizontal. First base 12 is wider than second base 14. Sides 16 and 18 slope inward from the edges of first base 12 to the edges of second base 14.

As shown in FIG. 1, module 10 has an open front of trapezoidal shape. Back 20 is also of trapezoidal shape, and is preferably attached to sides 16 and 18 and second base 14. In the preferred embodiments of the present invention, second base 14, sides 16 and 18, and back 20 are attached together for shipping. First base 12 is removable from the module, and may be shipped separately.

Also as shown in FIG. 1, first base 12 has a front edge 12' which is recessed in the center. The purpose of this recess is to permit easier viewing of goods displayed in a lower module when module 10 is stacked on top of another module with base 12 at the top.

The module of FIG. 1 is a preferred embodiment of the present invention in which second base 14 and sides 16 and 18 are of approximately equal width. In addition, first base 12 has a width which is approximately twice the width of second base 14. The angles between first base 12 and sides 16 and 18 are each approximately sixty degrees, while the angles between second base 14 and sides 16 and 18 are approximately one hundred twentry degrees.

The module 10 of the present invention may be used to form a variety of structures such as bookcases, cabinetry, or display shelves. The module may be used by itself, or in conjunction with many modules which are stacked and arranged to produce structures of unique configuration. In addition, various devices can be inserted into module 10 through its open front to subdivide the interior of the module or provide shelving within the module.

Figure 2:
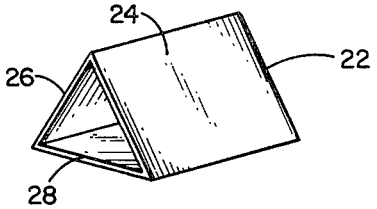
FIG. 2 shows a perspective view of a triangular honeycomb type insert which may be used in conjunction with the module of the present invention.

FIG. 2 shows a perspective view of a triangular honeycomb insert which may be used in conjunction with the module 10 of the present invention. Insert 22 preferably has three equal sides 24, 26, and 28, an open front and an open back. Sides 24, 26, and 28 define an open front having the shape of an equilateral triangle.

Figure 3:
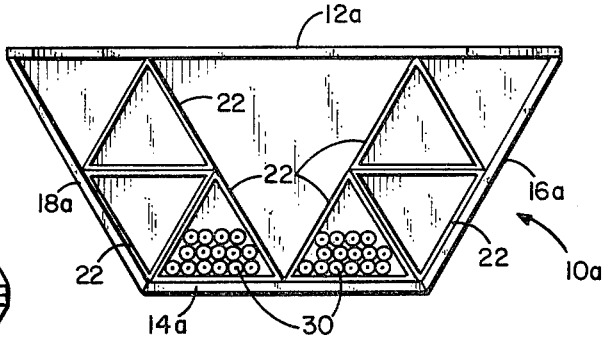
FIG. 3 is a front view of a module with honeycomb triangular inserts separating the module into a plurality of sections.

FIG. 3 shows module **10*a* in an inverted position (i.e. with first base 12*a* at the top and second base 14*a* at the bottom). Throughout the remainder of this specification modules in inverted orientation will be designed "10*a*", and modules in normal orientation (like that shown in FIG. 1) will be designated "10*b*". Several triangular honeycomb inserts 22 are positioned in the interior of module 10*a* to subdivide the interior into several display areas. In FIG. 3, merchandise 30**, such as candles, is shown in two of the triangular honeycomb inserts.

In the embodiment shown in FIG. 3, the sides 24, 26, and 28 of each triangular insert 22 have a special relationship to the widths of second base **14*a* and sides 16*a* and 18*a* of module 10*a*. In particular, the width of each side of the triangular inserts 22 is approximately one-half the width of second base 14*a* and sides 16*a* and 18*a*. In addition, because the angles defined by bases 12*a* and 14*a* with sides 16*a* and 18*a* are either sixty degrees or one hundred twenty degrees, the sixty degree angles of triangular inserts 22 conform well to the interior of module 10*a***.

Figure 4:
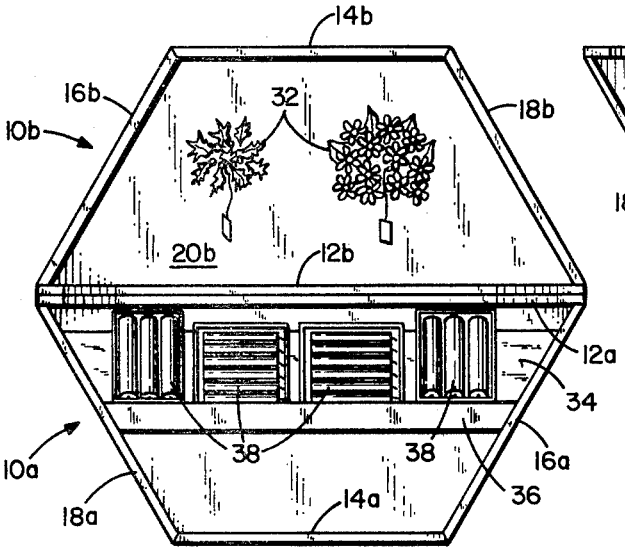
FIG. 4 is a front view of a display shelf assembly formed by two modules in stacked relation, and a trapezoidal shaped shelf inserted in the lower module.

FIG. 4 shows another embodiment of the present invention in which two modules **10*a* and 10*b* have been stacked to form a hexagonal shaped display case. Lower module 10*a* is in inverted position with first base 12*a* at the top of the module and second base 14*a* at the bottom of the module. Upper module 10*b* has its first base 12*b* at its bottom, overlying first base 12*a* of lower module 10*a*. Second base 14*b* module 10*b* is located at the top of the structure. As shown in FIG. 4, because of the special relationship between the widths of the bases and sides and the particular angles formed by the bases and sides, the front view of the stacked modules 10*a* and 10*b*** has the appearance of an equilateral hexagon.

In upper module **10*b*, artificial plants 32 are displayed by attachment to back 20*b*. This arrangement is preferably by means of hooks, and will be described in further detail in conjunction with FIGS. 10 and 11**.

In lower module **10*a*, a sloped trapezoidal shaped shelf 34 with a trapezoidal shaped flange 36 at its front edge displays boxes of candles 38. The sloped orientation of shelf 34 permits easy viewing and removal of merchandise such as candles 38** from the display.

Figure 5:
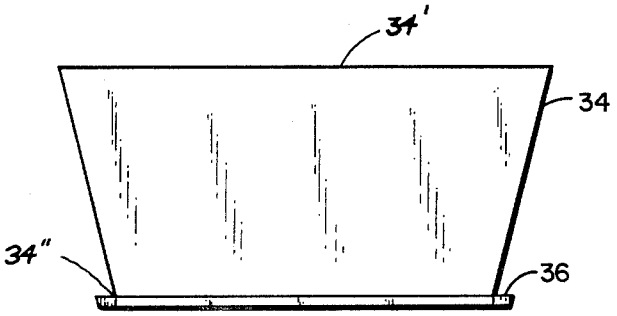
FIGS. 5 and 6 show two different sized trapezoidal shelves for use with the module of the present invention.
Figure 6:
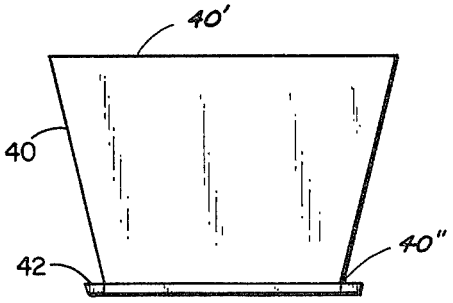

A particular advantage of the present invention is that inclined shelves like shelf 34 of FIG. 4 require no fasteners nor any special grooves in module **10*a*. This is because shelf 34 and flange 36 are trapezoidal shaped. FIGS. 5 and 6 show top view of trapezoidal shaped shelf 34, and a smaller trapezoidal shaped shelf 40. By use of these shelves, it is possible to provide multiple shelves in a single inverted module like module 10*a* in FIG. 4. Shelf 34 is wider and therefore is an upper shelf, while shelf 40 of FIG. 6 is a lower shelf. Like upper shelf 34, lower shelf 40 has a trapezoidal shaped flange 42 at its front edge which is essentially perpendicular to shelf 40**.

Figure 7:
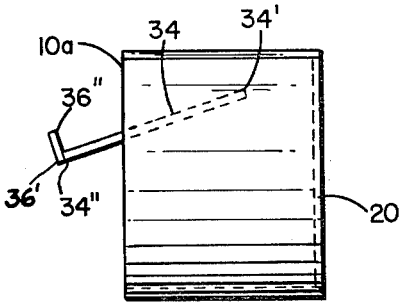
FIGS. 7 and 8 show a side view of a module with a trapezoidal shaped shelf being inserted with the shelf in inserted position within the module, respectively.
Figure 8:
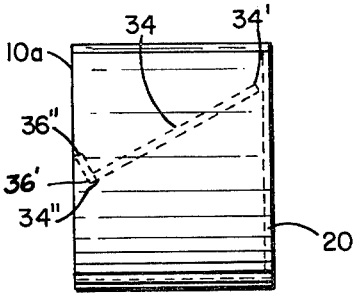

FIGS. 7 and 8 show the insertion of upper shelf 34 into a typical inverted module **10*a*. In FIG. 7, upper shelf 34 is being inserted, while in FIG. 8, upper shelf 34 is in its inserted position. It should be understood, of course, that the insertion of lower shelf 40** is accomplished in the same manner.

Flange 36 has a bottom edge 36' which is narrower than its top edge 36''. Bottom edge 36' is attached to front edge 34'' of shelf 34, and has a width which is essentially equal to the width of front edge 34''. Top edge 36'' is parallel to bottom edge 36' and has a greater width. The respective widths of top and bottom edges 36'' and 36' are selected so that when shelf 34 is in position in module **10*a*, as shown in FIG. 8, the sides of flange 36 bear against the inner surfaces of side walls 16*a* and 18*a*, thereby assisting in holding flange 36 and shelf 34** in place.

The trapezoidal shapes of shelf 34 and flange 36, together with the inverted trapezoidal shape of module **10*a*, assures that shelf 34 and flange 36 will be held in position without the need for any fasteners or special grooves. This is because back edge 34' of shelf 34 is wider than front edge 34'', and is engaged and held by the side walls 16*a* and 18*a* of module 10*a* at a higher location than is front edge 34''. As shown in FIG. 7, shelf 34 is inserted so that its back edge 34' reaches the back of module 10*a*. When shelf 34 is then released, it pivots downward until the ends of the front edge 34'' of shelf 34 and the ends of bottom edge 36' and top edge 36'' of flange 36 engage the walls 16*a* and 18*a*. The weight of shelf 34 and flange 36 then holds shelf 34 in position. In order for the trapezoidal shaped shelf 34 to be held in position, module 10*a* must be in inverted position, with the wider first base 12*a* at the top and the narrower second base 14*a* at the bottom. In addition, the back edge 34' of trapezoidal shaped shelf 34 must be no greater in width than the inside width of first base 12*a*. The front edge 34'' of trapezoidal shaped shelf 34 has a width which is less than the width of back edge 34' and greater than or equal to the width of second base 14*a***.

Figure 9:
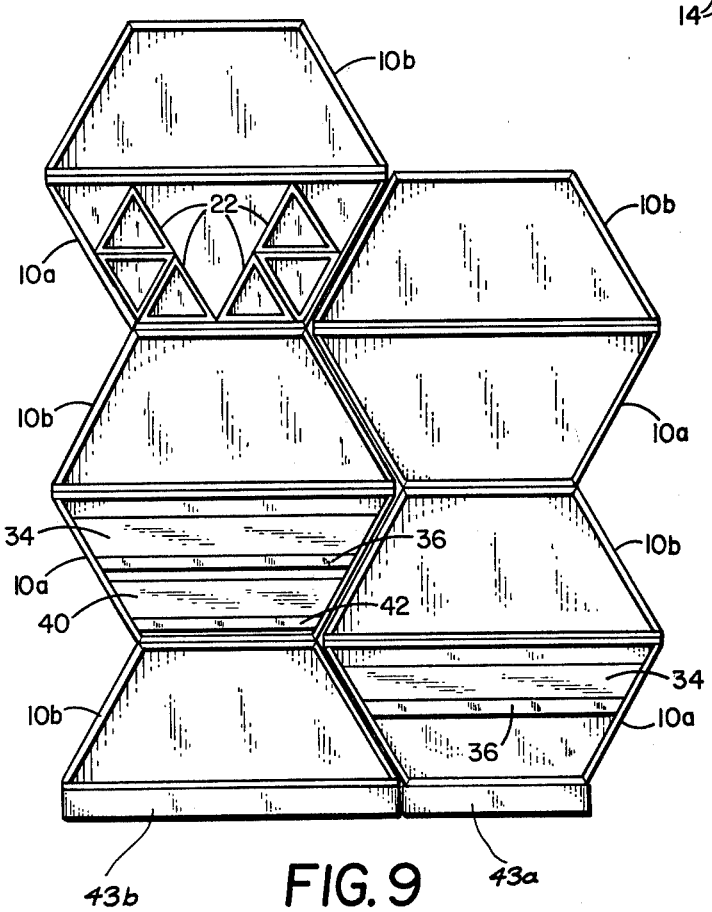
FIG. 9 shows another assembly using a plurality of modules.

Lower shelf 40 is inserted into inverted module **10*a* in a similar manner. Because the widths of both the back and front edges 40' and 40'' of lower shelf 40 are narrower than the widths of back and front edges 34' and 34'' of upper shelf 34, lower shelf 40 assumes a lower position in module 10*a*, as best shown in FIG. 9. As with upper shelf 34, lower shelf 40 is held securely in position due to the trapezoidal shape of both lower shelf 40 and flange 42. No fasteners or spacers are required to hold both upper shelf 34 and lower shelf 40** in position and spaced from one another.

Another advantage of the present invention is that shelves 34 and 40 may be pulled forward to permit removal or restocking of merchandise such as candles 38. When shelf 34 is pulled forward, so that the side walls of trapezoidal shaped flange 36 no longer engage the inner surfaces of sides 16*a* and 18*a*, the weight of shelf 34 and flange 36 tend to cause front edge 34″ of shelf 34 to tip downward and back edge 34′ to tip upward until back edge 34′ hits the inner surface of first base 12*a*. Shelf 34 and flange 36 are then held in position by their own weight without any fasteners, special slides, or the like. This allows removal or replenishment of merchandise without total removal of shelf 34.

Similarly, lower shelf 40 may be pulled partially out to permit replenishment of merchandise. Front edge 40″ of shelf 40 will tip downward, while back edge 40′ of shelf 40 tips upward until it engages the bottom surface of upper shelf 34. At that point, lower shelf 40 is held in position while merchandise is removed or replenished. It may then be placed back into position mereby by pushing it backward into the module 10*a*.

FIG. 9 shows another embodiment of the present invention in which nine modules are arranged in stacked and side-by-side arrangement to produce a display for merchandise. The modules in inverted orientation are each designated "10*a*", while the modules in normal orientation are designated "10*b*". In the embodiment shown in FIG. 9, modules which are side-by-side are inverted with respect to one another, so their side surfaces are parallel and essentially in contact. This provides an attractive structure and makes efficient use of space. Another side-by-side arrangement which differs somewhat from that shown in FIG. 9 is produced when the modules which are side-by-side have the same orientation. This also has been used to produce highly attractive structures for displaying merchandise.

FIG. 9 also illustrates the use of upper and lower shelves 34 and 40, respectively, in a single module 10*a*. As discussed previously, the shelves 34 and 40 may be used separately or together in the same module as desired.

Triangular inserts 22 are also shown in another of the modules forming the structure of FIG. 9. Inserts 22 are arranged in a similar manner to that shown in FIG. 3. It should be understood, however, that other arrangements of triangular inserts 22 may be used to separate and subdivide portions of the interior of a module, whether in normal or inverted position.

As shown in FIG. 9, the entire modular structure is supported on a pair of rectangular bases 43*a* and 43*b*. Base 43*a* is positioned below an inverted module 10*a*, and has dimensions which are substantially similar to the dimensions of second base 14*a*. Rectangular base 43*b* is larger than base 43*a*, and underlies and supports a module 10*b*. The dimensions of rectangular base 43*b* are substantially similar to the dimensions of a first base 12*b* of normal module 10*b*. Bases 43*a* and 43*b* provide support for the entire structure, and also space bottommost modules slightly off of the floor.

Figure 10:
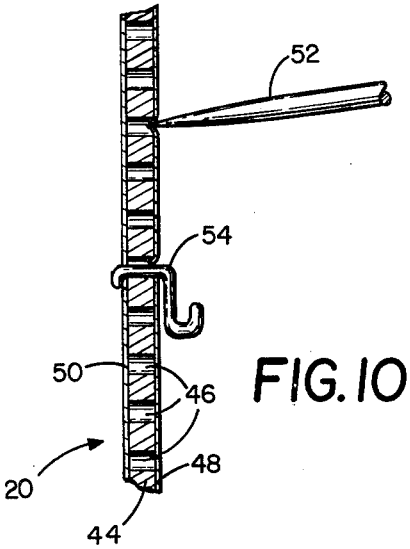
FIG. 10 shows a partial sectional view of the back wall of a module of the present invention.
Figure 11:
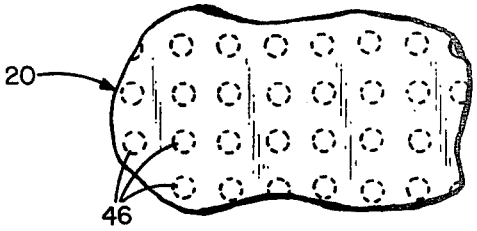
FIG. 11 shows a front view of a portion of the back wall.

The present invention also permits displaying of merchandise by means of hooks attached to back wall 20 of the module. FIGS. 10 and 11 show portions of back wall 20, which preferably comprise a peg board type core 44 containing a plurality of holes 46. On the outer surfaces of core 44 are attached thin laminations 48 and 50. These laminations may be of a matching or contrasting color to the remainder of the module.

When it is desired to display merchandise such as artificial plants 32 of FIG. 4 from back wall 20 of a module, a sharp pointed instrument, such as a needle or awl 52, may be used to puncture thin lamination 48. Hook 54 is then inserted through the hole formed in lamination 48 and through hole 46 of peg board core 44. Merchandise can then be attached to hook 54.

The use of a peg board core 44 with laminated coverings 48 and 50 provides an attractive back wall with no visible holes. If it is desired to display merchandise by means of hooks 54, peg board core 44 permits maximum flexibility in the location of hooks 54, and eliminates the need for drilling holes or other time-consuming processes.

As described previously, the present invention is simple to construct into attractive and complex structures with a minimum amount of effort and only the simplest of tools. This is, of course, a significant advantage of the present invention.

Figure 12:
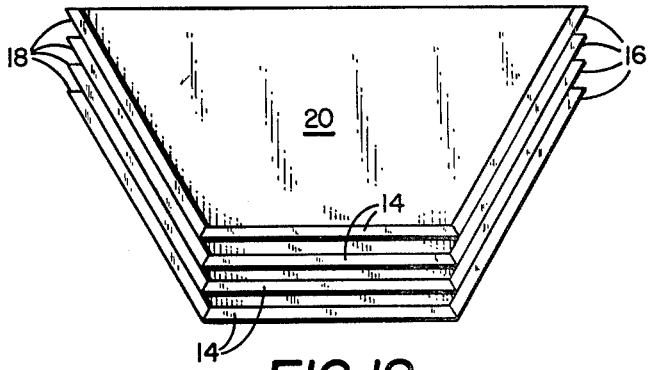
FIG. 12 shows four modules, with the first or larger base removed, in stacked relationship for shipping.

Another important advantage of the present invention is that it breaks down into small modules or submodules which are easily transported. As discussed previously, first base 12 of module 10 preferably may be removed for shipping purposes. FIG. 12 illustrates how several modules, with their first bases 12 removed, are stacked together for shipping. As shown in FIG. 12, four modules stacked together occupy only slightly more space than a single module.

The remaining portions of the structure may also be easily shipped, the first bases 12 are all flat and can be packed with several in a single container. Shelves 34 and 40 are also primarily flat and can be stacked and arranged in a manner which facilitates easy shipping. Triangular inserts 22 are regular in shape and also are relatively easy to ship.

In conclusion, the present invention is a highly advantageous modular structure which may be used to provide a wide variety of unique and attractive structures for displaying merchandise and the like. The modular nature of the structure is easy to assemble and requires a minimum number of fasteners. Shelving is provided which needs no fasteners at all, and honeycomb subdivision of the interior of modules also is provided without the use of fasteners. Finally, the structure, when disassembled, is compact and well-adapted for shipping and other transportation.

Although the present invention has been described with reference to preferred embodiments, workers skilled in the art will recognize that changes may be made in form and detail without departing from the spirit and scope of the invention. For example, for the purposes of illustration only a limited number of structures formed by the modules of the present invention have been shown. It is clear, however, that a wide variety of different shaped structures can be formed by different arrangements of the modules. In addition to the examples shown, in which either first base 12 or second base 14 has been at the bottom of the module, attractive structures have also been formed in which some of the modules are arranged with either side 16 or side 18 at the bottom.

Attractive structures can also be made in which the modules have their open faces staggered or oriented at angles with respect to one another. In this manner, an attractive structure can be formed which has a curved appearance or which extends around a corner.

What is claimed is:

1. A shelving device comprising:

a quadrilateral module having a generally rectangular top, a generally rectangular bottom, and first and second generally rectangular side walls defining an open front of trapezoidal shape, the top and bottom being parallel to one another and having substantially similar depth, with the top having a width greater than the bottom; and a first trapezoidal shaped shelf or insertion in the module, the first trapezoidal shaped shelf having a front edge, a back edge, and first and second side edges, the front and back edges being essentially parallel to one another and the back edge having a width less than or equal to the width of the top of the module and greater than the width of the bottom of the module, the front edge of the first trapezoidal shaped shelf having a width less than the width of the back edge and greater than or equal to the width of the bottom of the module, whereby the first trapezoidal shaped shelf, when inserted in the module, slopes downward from the back edge to the front edge.

2. The shelving device of claim 1 and further comprising flange means attached to the shelf.

3. The shelving device of claim 2 wherein the flange means is positioned proximate and generally parallel to the front edge of the shelf and extends generally upward from an upper surface of the shelf.

4. The shelving device of claim 3 wherein the flange means is trapezoidal shaped with a bottom edge having a width essentially equal to the width of the front edge of the shelf and a top edge which is substantially parallel to the bottom edge and has a width greater than the width of the bottom edge.

5. The shelving device of claim 1 wherein the dimension of the first trapezoidal shaped shelf from front edge to back edge is greater than the depth of the module.

6. The shelving device of claim 1 and further comprising:

a second trapezoidal shaped shelf for insertion in the module, the second trapezoidal shaped shelf having a front edge, a back edge, and first and second side edges, the front and back edges being essentially parallel to one another and the back edge having a width less than the width of the back edge of the first trapezoidal shelf and greater than the width of the bottom of the module, the front edge of the second trapezoidal shaped shelf having a width less than the width of the back edge of the second trapezoidal shelf and the front edge of the first trapezoidal shaped shelf and greater than or equal to the width of the bottom of the module, whereby the second trapezoidal shaped shelf, when inserted in the module, slopes downward from the back edge to the front edge and is positioned below the first trapezoidal shaped shelf.

7. A structure comprising a plurality of identical quadrilateral modules, each module having a generally rectangular top, a generally rectangular bottom having substantially similar depth but different width than the top, and first and second generally rectangular side walls defining an open front of trapezoidal shape, the top and bottom being parallel to one another, the modules being arranged in stacked, inverted relationship so that the top of a lower module and the bottom of an upper module are of equal width and are positioned proximate one another.

8. The structure of claim 7 and further comprising:

a first trapezoidal shaped shelf for insertion in a module in which its top is wider than its bottom, the first trapezoidal shaped shelf having a front edge, a back edge, and first and second side edges, the front and back edges being essentially parallel to one another and the back edge having a width less than or equal to the width of the top of the module and greater than the width of the bottom of the module, the front edge of the first trapezoidal shaped shelf having a width less than the width of the back edge and greater than or equal to the width of the bottom of the module, whereby the first trapezoidal shaped shelf, when inserted in the module, slopes downward from the back edge to the front edge.

9. The shelving device of claim 8 and further comprising:

a second trapezoidal shaped shelf for insertion in the module, the second trapezoidal shaped shelf having a front edge, a back edge, and first and second side edges, the front and back edges being essentially parallel to one another and the back edge having a width less than the width of the back edge of the first trapezoidal shelf and greater than the width of the bottom of the module, the front edge of the second trapezoidal shaped shelf having a width less than the width of the back edge of the second trapezoidal shelf and the front edge of the first trapezoidal shaped shelf and greater than or equal to the width of the bottom of the module, whereby the second trapezoidal shaped shelf, when inserted in the module, slopes downward from the back edge to the front edge and is positioned below the first trapezoidal shaped shelf.

10. A structure comprising a plurality of identical quadrilateral modules, each module having a first generally rectangular base and a second generally rectangular base and first and second generally rectangular side walls defining an open front of trapezoidal shape, the first and second bases being parallel to one another and having substantially similar depths, and the first base being wider than the second base.

11. The structure of claim 10 wherein the modules are arranged in stacked, inverted relationship so that bases of substantially equal width of an upper and a lower module are positioned proximate one another.

12. The structure of claim 10 wherein the first bases of the modules have a recessed portion in their front edges.

13. The structure of claim 10 wherein the first and second sides and the second base have essentially the same width.

14. The structure of claim 13 wherein the first base has a width of approximately twice the width of the second base.

15. The structure of claim 14 and further comprising:

triangular honeycomb inserts for insertion in a module to divide the module into a plurality of sections.

16. The structure of claim 15 wherein the triangular honeycomb insert has an equilateral triangular shaped open front.

17. The structure of claim 16 wherein the triangular honeycomb insert has sides having a width substantially equal to one-half the width of the second base.

18. The structure of claim 10 wherein the module has a trapezoidal shaped back.

19. The structure of claim 18 wherein the trapezoidal shaped back comprises:

a core having a pluraliity of holes therein; and a thin laminated covering over the front surface of the core, the thin laminated covering being puncturable to permit hooks to be inserted into the holes in the core.

20. The structure of claim 10 and further comprising:

a first trapezoidal shaped shelf for insertion in a module having the first base at its top and its second base at its bottom, the first trapezoidal shaped shelf having a front edge, a back edge, and first and second side edges, the front and back edges being essentially parallel to one another and the back edge having a width less than or equal to the width of the first base of the module and greater than the width of the second base of the module, the front edge of the first trapezoidal shaped shelf having a width less than the width of the back edge and greater than or equal to the width of the second base, whereby the first trapezoidal shaped shelf, when inserted in the module, slopes downward from the back edge to the front edge.

21. The structure of claim 20 and further comprising:

a second trapezoidal shaped shelf for insertion in the module having the first base at its top and its second base at its bottom, the second trapezoidal shaped shelf having a front edge, a back edge, and first and second side edges, the front and back edges being essentially parallel to one another and the back edge having a width less than the width of the back edge of the first trapezoidal shaped shelf and greater than the width of the second base of the module, the front edge of the second trapezoidal shaped shelf having a width less than the width of the back edge of the second trapezoidal shelf and less than the width of the front edge of the first trapezoidal shelf and greater than or equal to the width of the second base, whereby the second trapezoidal shaped shelf, when inserted in the module, slopes downward from the back edge to the front edge and is positioned lower than the first trapezoidal shaped shelf in the module.

* * * * *